US008496443B2

(12) United States Patent
Campbell et al.

(10) Patent No.: US 8,496,443 B2
(45) Date of Patent: Jul. 30, 2013

(54) MODULAR TURBINE AIRFOIL AND PLATFORM ASSEMBLY WITH INDEPENDENT ROOT TEETH

(75) Inventors: Christian X. Campbell, Oviedo, FL (US); Daniel O. Davies, Palm City, FL (US); Darryl Eng, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 571 days.

(21) Appl. No.: 12/793,935

(22) Filed: Jun. 4, 2010

(65) Prior Publication Data

US 2011/0142639 A1 Jun. 16, 2011

Related U.S. Application Data

(63) Continuation-in-part of application No. 12/638,034, filed on Dec. 15, 2009, now Pat. No. 8,231,354.

(51) Int. Cl.
*F01D 5/30* (2006.01)

(52) U.S. Cl.
USPC ..... 416/248

(58) Field of Classification Search
USPC ..... 416/239, 248, 193 A, 244 A, 214 A, 416/214 R, 219 R; 29/889.22
See application file for complete search history.

(56) References Cited

U.S. PATENT DOCUMENTS

| | | | | | |
|---|---|---|---|---|---|
| 1,516,607 | A * | 11/1924 | Johanson | 416/239 |
| 2,807,435 | A * | 9/1957 | Howlett et al. | 416/248 |
| 2,934,317 | A * | 4/1960 | Warnken | 416/248 |
| 2,942,842 | A | 6/1960 | Hayes | |
| 3,012,308 | A * | 12/1961 | Zech et al. | 416/219 R |
| 3,732,031 | A | 5/1973 | Bowling et al. | |
| 3,810,711 | A | 5/1974 | Emmerson et al. | |
| 4,297,077 | A | 10/1981 | Durgin et al. | |
| 4,444,544 | A | 4/1984 | Rowley | |
| 4,583,914 | A | 4/1986 | Craig et al. | |
| 4,650,399 | A | 3/1987 | Craig et al. | |
| 5,147,180 | A | 9/1992 | Johnson | |
| 5,639,216 | A | 6/1997 | McLaurin et al. | |
| 5,797,725 | A | 8/1998 | Rhodes | |
| 6,331,217 | B1 * | 12/2001 | Burke et al. | 416/241 R |
| 6,726,452 | B2 | 4/2004 | Strassberger et al. | |
| 6,786,696 | B2 | 9/2004 | Herman et al. | |
| 7,080,971 | B2 | 7/2006 | Wilson et al. | |
| 7,351,036 | B2 | 4/2008 | Liang | |
| 2010/0124502 | A1 * | 5/2010 | Brandl et al. | 416/193 A |

* cited by examiner

*Primary Examiner* — Richard Edgar

(57) ABSTRACT

A turbine airfoil (22E-H) extends from a shank (23E-H). A platform (30E-H) brackets or surrounds a first portion of the shank (23E-H). Opposed teeth (33, 35) extend laterally from the platform (30E-H) to engage respective slots (50) in a disk. Opposed teeth (25, 27) extend laterally from a second portion of the shank (29) that extends below the platform (30E-H) to engage other slots (52) in the disk. Thus the platform (30E-H) and the shank (23E-H) independently support their own centrifugal loads via their respective teeth. The platform may be formed in two portions (32E-H, 34E-H), that are bonded to each other at matching end-walls (37) and/or via pins (36G) passing through the shank (23E-H). Coolant channels (41, 43) may pass through the shank beside the pins (36G).

18 Claims, 6 Drawing Sheets

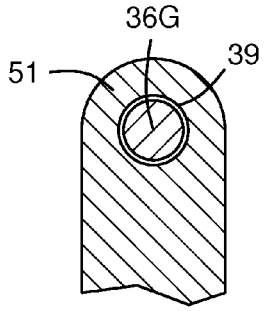
FIG 6
FIG 7
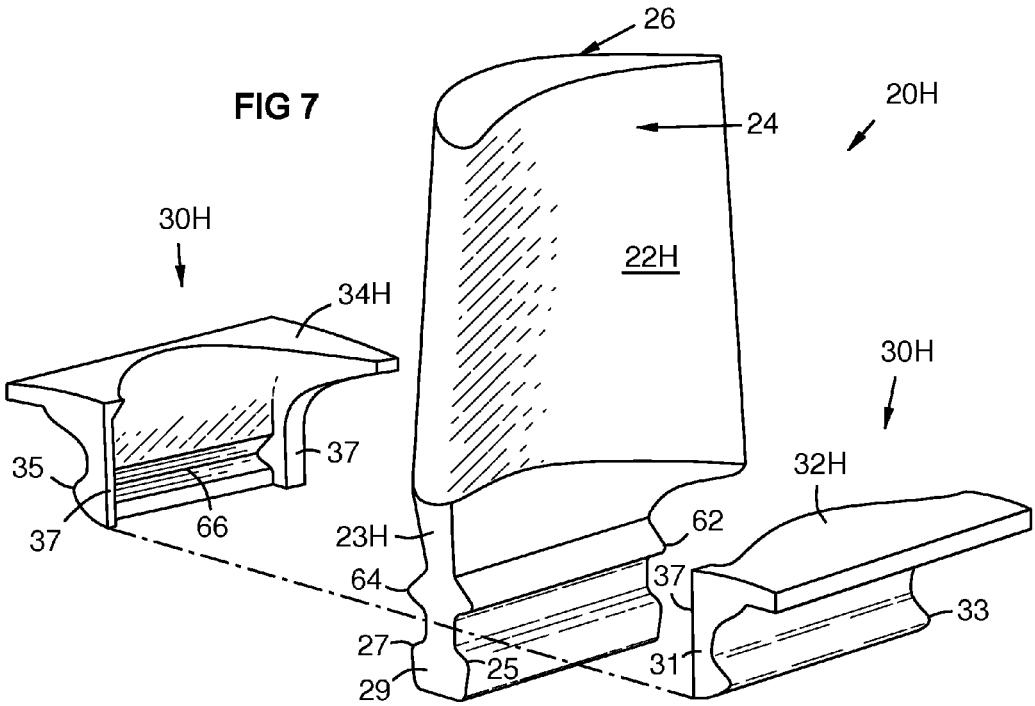

MODULAR TURBINE AIRFOIL AND PLATFORM ASSEMBLY WITH INDEPENDENT ROOT TEETH

CROSS-REFERENCE TO RELATED APPLICATIONS

This application is a continuation-in-part of U.S. patent application Ser. No. 12/638,034 filed on 15 Dec. 2009 now U.S. Pat. No. 8,231,354 incorporated by reference herein.

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates to fabrication and assembly of turbine engine airfoils and platforms, and mounting of such assemblies on a turbine disk.

BACKGROUND OF THE INVENTION

Turbine engines have at least one circular array of blades mounted around the circumference of a rotor disk. Each blade can be mounted by forming a mounting platform on the shank of the blade, in which the platform has a dovetail geometry that slides axially into a matching slot in the disk. U.S. Pat. No. 5,147,180 shows an example of a platform having an inverted "fir tree" geometry with multiple lateral teeth of descending width that is sometimes used.

The blade and platform may be cast integrally of an advanced single crystal superalloy such as CMSX-4 or PWA1484. However, casting the blade and platform in one piece has disadvantages. The size of the hole in the baffle through which the casting is withdrawn during the single crystal solidification process is dictated by the largest cross-sectional area of the part, which is usually the platform in the case of an integrally cast blade. The thermal gradient is not optimized when the baffle does not closely fit around the casting and can lead to the formation of casting defects such as low and high angle grain boundaries. It is also difficult to maintain the single crystal structure in regions where there are large geometric changes in the casting, for example in the fillet region where the airfoil transitions to the platform. Casting defects such as 'freckle chains' are often observed. Material requirements of the blade and platform are different. The blade must tolerate high temperatures and corrosive gas flow. The platform does not reach the highest temperatures of the blade, but needs strength and castability.

Forming the blade and platform as a single piece does not allow material optimization. However, forming them of separate pieces involves fastening, close tolerances, stress concentrations, and vibration issues. U.S. Pat. No. 7,080,971 shows a platform attached to a blade by a pin inserted through a hole passing completely through the platform and shank. This causes stress concentrations.

BRIEF DESCRIPTION OF THE DRAWINGS

The invention is explained in the following description in view of the drawings that show:

FIG. 6 is a sectional view of an undersized pin in a hole in the shank.

FIG. 7 is a sectional view of a fourth embodiment of the invention.

DETAILED DESCRIPTION OF THE INVENTION

Figure 1:
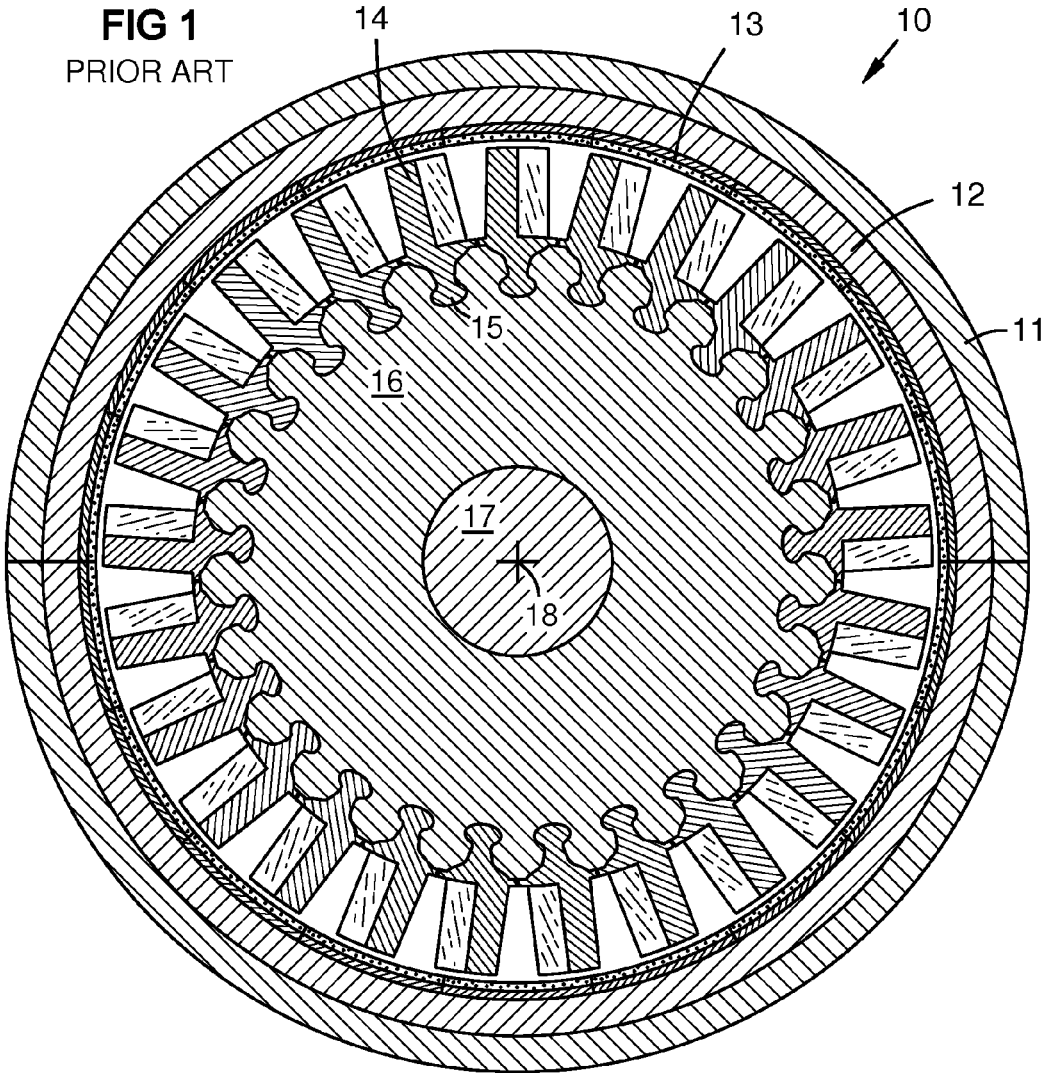
FIG 1 PRIOR ART
FIG. 1 is a conceptual sectional view of a gas turbine disk and blades as known in the art.

FIG. 1 shows conceptual sectional view of a known gas turbine engine 10 with a casing 11, a retaining ring 12, and a shroud 13, taken on a section plane through a turbine rotor disk 16. Blades 14 with integral platforms 15 are mounted around the disk using a dovetail joint geometry. The disk is mounted on an axle 17 having a rotation axis 18.

Figure 2:
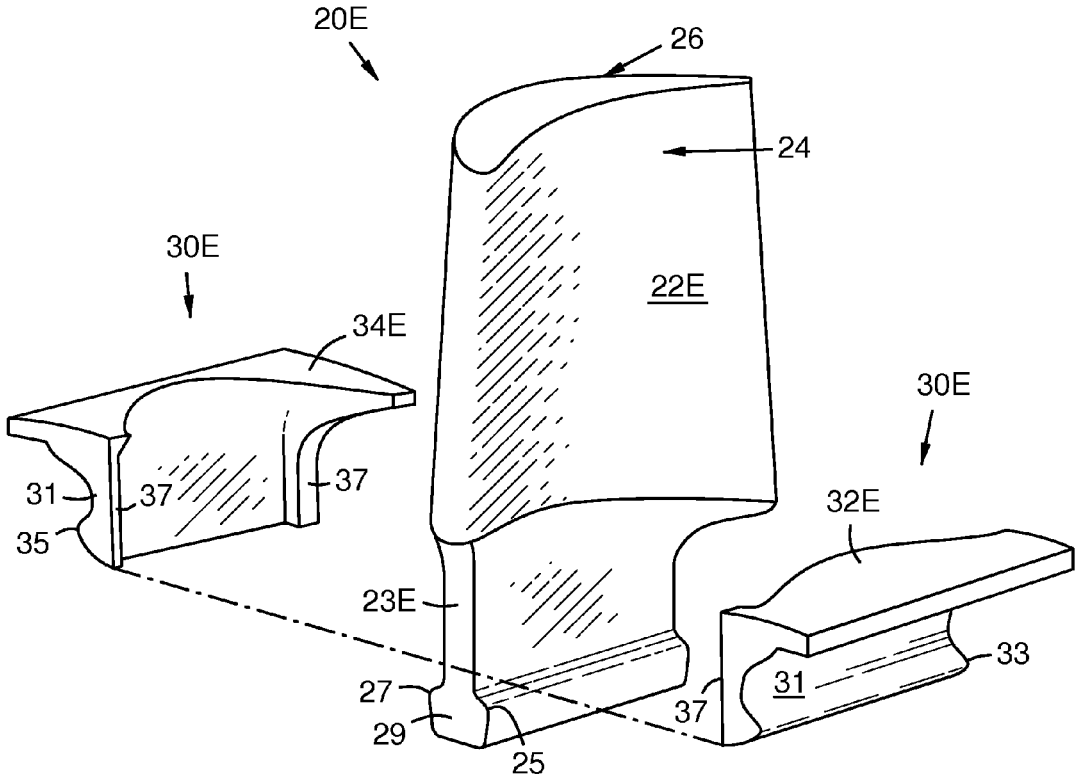
FIG. 2 is an exploded perspective view of a turbine blade assembly according to aspects of the invention.

FIG. 2 shows a turbine blade assembly 20E, including a blade or airfoil 22E having a pressure side 24, a suction side 26, and a shank 23E. A platform 30E has pressure and suction side portions 32E, 34E, and each platform portion has a root portion 31 with at least one laterally extending tooth 33, 35 that engages the rotor disk 16 as later shown. After assembly, the platform 30E brackets (at least partially or completely surrounding) a first portion of the shank 23E. The shank 23E extends below the platform 30E, or radially inward of the platform 30E when mounted in a turbine disk. Herein, "axially" and "radially" are meant in relation to the disk axis 18. A second part of the shank 29 extends outside the platform 30E, and has at least two opposed laterally extending teeth 25, 27 that engage the rotor disk. The blade and shank may be integrally formed, for example in a casting process. The two platform portions 32E, 34E may be formed separately from the shank 23E, and thus may be formed of a different material.

The two platform portions 32E, 34E may be bonded to each other at matching end-walls 37 around the shank 23E by means such as metal diffusion bonding, transient liquid phase bonding, or brazing. Forming the platform in two parts and bonding them together around the shank allows each platform part 32E, 34E to be formed as a single crystal. The airfoil 22E and shank 23E may be formed of a first metal alloy, and the platform 30E may be formed of a second metal alloy, allowing specialization of material properties. For the same reason, the airfoil 22E and shank 23E may be formed of a ceramic or ceramic matrix composite, and the platform 30E may be formed of a metal alloy. As an alternative to forming the platform in two parts 32E, 34E, and bonding them together around the shank, the platform 30E may be bi-cast onto the shank 23E.

Figure 3:
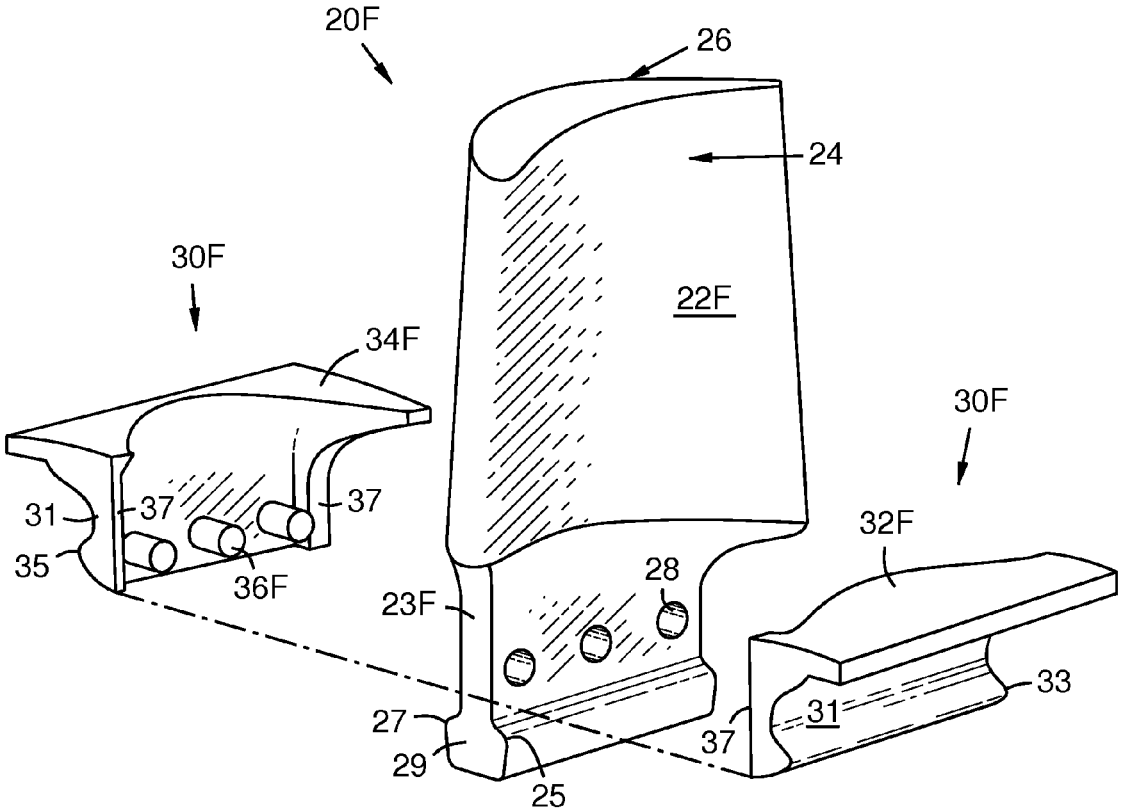
FIG. 3 is an exploded perspective view of second embodiment of the invention.

FIG. 3 shows a turbine blade assembly 20F, including a blade or airfoil 22F having a pressure side 24, a suction side 26, and a shank 23F. A platform 30F has pressure and suction side portions 32F, 34F, each having a root portion 31 with at least one laterally extending tooth 33, 35 that engages the rotor disk. After assembly, the platform 30F surrounds or brackets a first portion of the shank 23F. A second portion of the shank 29 extends outside the platform 30F, or radially inward of the platform 30F when mounted in a turbine disk.

The part of the shank 29 outside the platform 30F has at least two opposed laterally extending teeth 25, 27 that engage the rotor disk.

Embodiment 20F has pins 36F on one or both platform portions 32F, 34F that pass through pin holes 28 in the shank 23F. The pins 36F may be bonded to the opposite platform portion after assembly. For example pins 36F on platform portion 34F as shown, may be bonded to platform portion 32F in the same manner as the matching end-walls 37 previously described. End-walls 37 are not needed when pins are used, but the pins may be in addition to end-walls. The pins connect the two platform portions 32F, 34F. The pins may fill the holes 28 and thus provide load sharing between the shank and the platform.

Alternately, the pins may be undersized in the holes 28 so that there is no load transfer between the shank and the platform. In this embodiment, the pins perform the function of connecting the two platform portions 32F, 34F. Providing at least one pin is beneficial, because it can be used to provide a clamping force of the platform onto the shank, thus increasing vibration frequencies, reducing leakage gaps, and increasing damping.

It is not necessary for the pins 36F to support all or any of the centrifugal load of either the blade or platform, since the teeth 25, 27, 33, 35 perform this function. As a result, the pins can be much smaller in diameter than if they supported the load of the airfoil. Smaller pins allow more space in the shank for cooling passages, while leaving enough material in the shank for strength and rigidity to carry the airfoil load via the shank teeth 25, 27.

The pins 36F may be integrally formed with a platform portion 34F, and bonded to the opposed platform portion 32F. Alternately, the platforms and pins may be formed by bi-casting the platform 30F onto the already-formed shank. In either of these embodiments, the platforms lack holes extending to an outer surface of the platform for the pins, such as found in U.S. Pat. No. 7,080,971. This lack of holes in the outer surface of the platform allows the thickness of the platform 30F to be reduced, and stress concentrations therein to be reduced.

Figure 4:
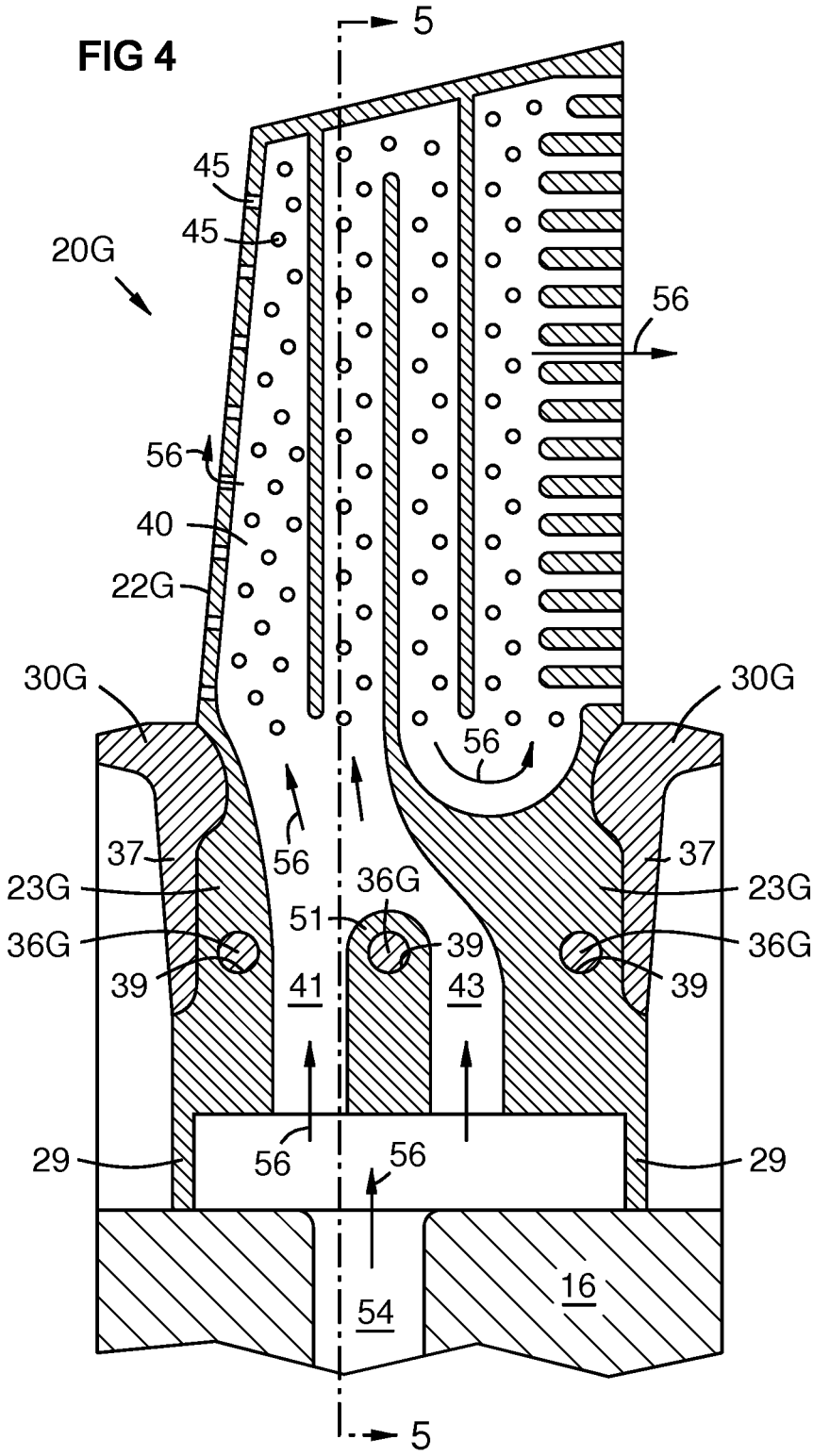
FIG. 4 is a sectional view of a third embodiment of the turbine blade assembly with internal cooling, taken along a sectioning surface halfway between the pressure and suction sides of the airfoil and shank.
Figure 5:
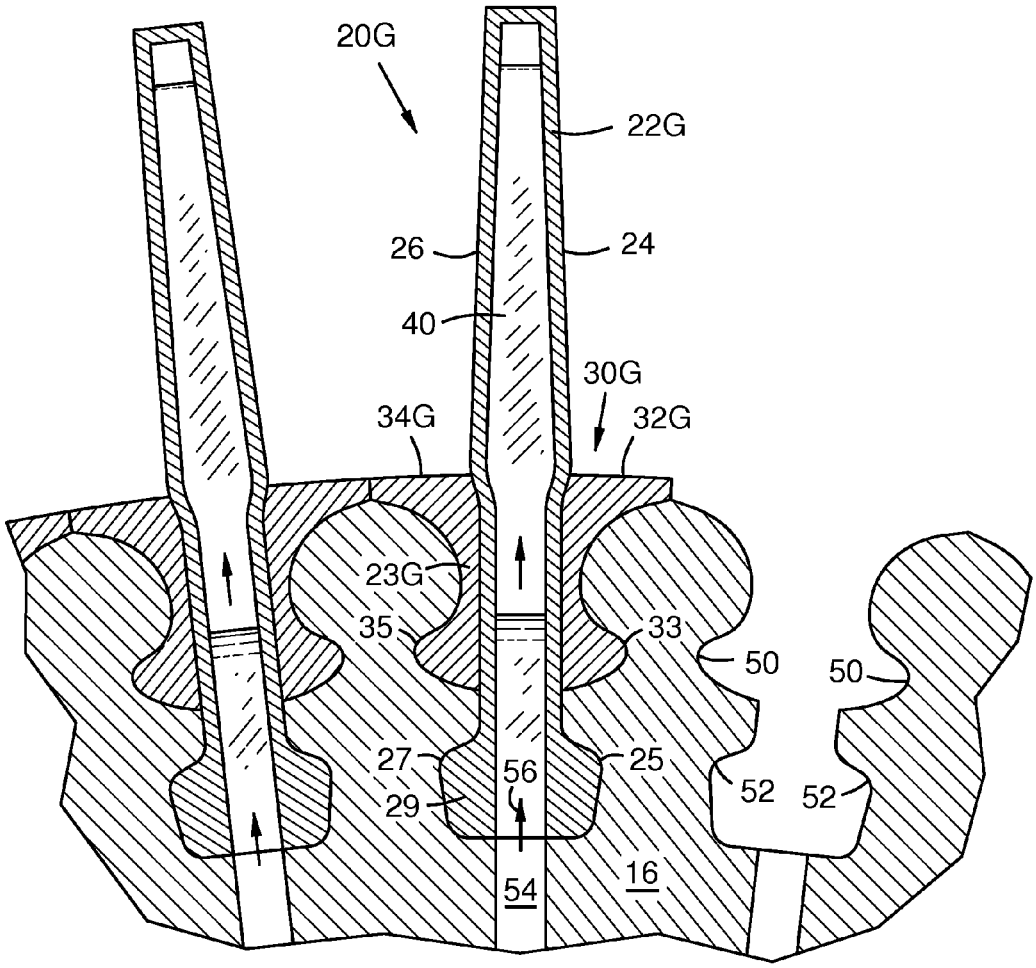
FIG. 5 is a sectional front view of blade assemblies taken on line 5-5 of FIG. 4 and mounted in a turbine disk.

FIG. 4 is a view of a turbine blade assembly 20G mounted in a turbine disk 16, viewed on a section surface halfway between the pressure and suction sides of the airfoil and shank. The airfoil 22G has one or more internal cooling chambers 40 that receive a coolant fluid 56 such as air or steam via channels 54 in the disk 16. The shank 23G has cooling channels 41 and 43 that may pass beside the pins 36G as shown to provide a desired total coolant channel sectional area. For example, the cooling channels 41, 43 may branch around a central one of the pins 36G. The pins may be sleeved by respective walls 51 of the pin holes 39 along their length, rather than spanning freely across a cooling channel void in the shank. The walls 51 may be formed integrally with the shank material. The walls 51 improve rigidity in the shank, and prevent flexing in the shank due to clamping by the platform 30G. The coolant 56 may exit the blade via film cooling holes 45 in the airfoil and/or other means known in the art. Various combinations of pins and end-walls 37 may be used. For example, a single central pin may be used with end-walls, or three pins may be used with or without end-walls FIG. 5 is a sectional front view of blade assemblies 20G taken on line 5-5 of FIG. 4. The teeth 25, 27 of the shank, and the teeth of the platform 33, 35 may slide axially into respective slots 50, 52 in the rotor disk 16. The centrifugal load of the airfoil 22G is transferred to the disk 16 through the teeth 25, 27 on the shank. The centrifugal load of the platform 30G is transferred to the disk 16 through the teeth 33, 35 on the platform 30G. The shank 23G and platform 30G do not need to be bonded to each other, and they may have a geometry that allows them to slide relative to each other at least to the extent of differential thermal expansion during operation.

FIG. 6 shows a pin 36G in a pin hole 39 with a wall 51. In this example, the pin is undersized in the pin hole, leaving a clearance gap between the pin and the wall 51 of the hole, so that the pin does not cause load sharing between the shank 23G and the platform 30G.

FIG. 7 shows a turbine blade assembly 20H, including an airfoil 22H having a pressure side 24, a suction side 26, and a shank 23H. A platform 30H has pressure and suction side portions 32H, 34H, each having a root portion 31 with at least one laterally extending tooth 33, 35 that engages the rotor disk 16. After assembly, the platform 30H surrounds or brackets the shank 23H. The shank 23H extends below the platform 30H, or radially inward of the platform 30H when mounted in a turbine disk. Part of the shank 29 outside of the platform 30H has at least two opposed laterally extending teeth 25, 27 that engage the rotor disk. In this embodiment, the portion of the shank 23H within the platform 30H may have laterally extending teeth 62, 64 that engage corresponding sockets 66 in the platform to provide centrifugal load sharing between the shank 23H and the platform 30H.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine airfoil and platform assembly comprising:

a turbine airfoil extending from a shank;

a platform bracketing a first portion of the shank;

a first pair of opposed teeth extending laterally from the platform; and a second pair of opposed teeth extending laterally from a second portion of the shank that extends beyond the platform;

wherein the platform is formed of first and second platform portions, the first platform portion comprising integral pins, the shank comprising respective through-holes for the pins, and the first and second platform portions are connected to each other by the pins passing through the through-holes and a bond between the pins and the second platform portion;

wherein the pins are sufficiently undersized in the through-holes that they do not support a centrifugal load of the airfoil.

2. The turbine airfoil and platform assembly of claim 1, wherein the turbine airfoil and shank are integrally formed, the platform is formed of a suction side portion and a pressure side portion, and the two platform portions are bonded together at matching end-wall surfaces of the two platform portions around the first portion of the shank.

3. The turbine airfoil and platform assembly of claim 1, wherein the turbine airfoil and shank are formed integrally of a first material and the platform is formed of a different material than the first material.

4. The turbine airfoil and platform assembly of claim 1, wherein the teeth of the shank and the teeth of the platform slide axially into respective slots in a turbine rotor disk.

5. The turbine airfoil and platform assembly of claim 1, wherein the shank and the platform are not bonded together, and they comprise a geometry that allows them to slide relative to each other at least to an extent of differential thermal expansion during operational temperature changes.

6. The turbine airfoil and platform assembly of claim 1, wherein the airfoil comprises a cooling chamber, and the shank comprises coolant passages that pass beside the one of the pins and communicate between the cooling chamber and a radially inner end of the shank, wherein said one pin is fully sleeved in a material of the shank, and said one pin interconnects the first and second portions of platform without a hole for said one pin in the platform that extends to an outer surface of the platform.

7. The turbine airfoil and platform assembly of claim 1, wherein the first platform portion comprises three pins that pass through respective pin holes in the shank and interconnect the first and second portions of the platform on opposed sides of the shank, wherein the shank comprises coolant passages that communicate between a cooling chamber in the airfoil and a radially inner end of the shank, wherein the coolant passages pass on each side of a central one of the pins that is fully sleeved in a material of the shank.

8. A turbine airfoil and platform assembly comprising:

a turbine airfoil extending from a shank;

a platform bracketing a first portion of the shank;

a first pair of opposed teeth extending laterally from the platform;

a second pair of opposed teeth extending laterally from a second portion of the shank that extends beyond the platform; and a third pair of opposed teeth extending laterally from the first portion of the shank within the platform, the third pair of opposed teeth engaging corresponding sockets in the platform, wherein centrifugal loads are shared between the shank and the platform.

9. A turbine airfoil and platform assembly comprising:

a turbine airfoil extending from a shank;

a platform comprising opposed pressure and suction side portions bracketing a first portion of the shank;

a first pair of opposed teeth extending laterally respectively from the opposed pressure and suction side portions of the platform;

a second pair of opposed teeth extending laterally from a second portion of the shank extending outside the platform;

a pin passing through a pin hole in the shank and interconnecting the pressure and suction side portions of the platform;

wherein the pin engages the platform without a hole therefore extending to an outer surface of the platform;

a cooling chamber in the turbine airfoil;

cooling passages communicating between the cooling chamber and a radially inner end of the shank;

the cooling passages branching around a wall of the pin hole.

10. The turbine airfoil and platform assembly of claim 8, wherein the platform is bi-cast onto the first portion of the shank.

11. The turbine airfoil and platform assembly of claim 8, wherein the second pair of opposed teeth on the shank and the teeth of the platform slide axially into respective slots in a turbine rotor disk.

12. The turbine airfoil and platform assembly of claim 8, wherein the shank and the platform are not bonded together, and they comprise a geometry that allows them to slide relative to each other at least to an extent of differential thermal expansion during operational temperature changes.

13. The turbine airfoil and platform assembly of claim 9, wherein the two platform portions are bonded together at matching end-wall surfaces of the two platform portions around the first portion of the shank.

14. The turbine airfoil and platform assembly of claim 9, wherein the turbine airfoil and shank are formed integrally of a first material and the platform is formed of a different material than the first material.

15. The turbine airfoil and platform assembly of claim 9, wherein the platform is bi-cast onto the first portion of the shank.

16. The turbine airfoil and platform assembly of claim 9, wherein the teeth of the shank and the teeth of the platform slide axially into respective slots in a turbine rotor disk.

17. The turbine airfoil and platform assembly of claim 9, wherein the shank and the platform are not bonded together, and they comprise a geometry that allows them to slide relative to each other at least to an extent of differential thermal expansion during operational temperature changes.

18. The turbine airfoil and platform assembly of claim 9, wherein the pin is sufficiently undersized in the pin hole that it does not support a centrifugal load of the airfoil.

* * * * *